US006727475B2

(12) United States Patent
Kennard et al.

(10) Patent No.: US 6,727,475 B2
(45) Date of Patent: Apr. 27, 2004

(54) HEATING CONTROL SYSTEM WHICH MINIMIZES AC POWER LINE VOLTAGE FLUCTUATIONS

(75) Inventors: James W. Kennard, Fairport, NY (US); Daniel E. Merriam, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 243 days.

(21) Appl. No.: 09/915,879

(22) Filed: Jul. 27, 2001

(65) Prior Publication Data

US 2003/0019866 A1 Jan. 30, 2003

(51) Int. Cl.[7] ..... H05B 3/02
(52) U.S. Cl. ..... 219/482; 219/497
(58) Field of Search ..... 219/497, 501, 219/482, 490, 492, 507, 508, 216; 363/49, 54, 125–128, 85, 86; 323/319, 235; 327/141, 476, 494, 587, 588

(56) References Cited

U.S. PATENT DOCUMENTS 3,486,042 A * 12/1969 Watrous ..... 327/452
3,633,095 A * 1/1972 Hood ..... 323/319
4,435,677 A * 3/1984 Thomas ..... 323/235
4,900,900 A * 2/1990 Shirae et al. ..... 219/501
4,902,877 A * 2/1990 Grasso et al. ..... 219/483
5,880,578 A * 3/1999 Oliveira et al. ..... 323/235

FOREIGN PATENT DOCUMENTS

EP 989663 A2 * 3/2000 ..... H02M/5/257

OTHER PUBLICATIONS

The European Standard, 1995, Part 3, Limits: Electromagnetic Compatibility (EMC), IEC 1000–3–3.

* cited by examiner

*Primary Examiner*—Tu Ba Hoang
(74) *Attorney, Agent, or Firm*—William F. Noval

(57) ABSTRACT

An electrical heater control system reduces flicker. The system includes an electrical heating system; an AC (alternating current) power source for supplying AC current to the electrical heating system; an AC power control device connected between the electrical heating system and the AC power source for controlling the supply of AC current to the electrical heating system; and a controller unit coupled to the AC power control device for activating the device at zero crossings of the AC power to minimize flicker in AC current supplied to the electrical heating system from the AC power source.

7 Claims, 4 Drawing Sheets

HEATING CONTROL SYSTEM WHICH MINIMIZES AC POWER LINE VOLTAGE FLUCTUATIONS

FIELD OF THE INVENTION

This invention relates in general to AC (alternating current) Power Control; and more specifically to the simple control and distribution of AC power to heater loads typically found in X-ray film processing equipment, dual laminator, roller heaters, splicer heaters, dual fuser roller heaters, and other temperature controlled heating equipment. The technique of the invention reduces the AC line voltage fluctuations caused when high power is applied to the heaters and provides power management options and temperature control.

BACKGROUND OF THE INVENTION

New European EMC regulations (FY2001), require that all electrical equipment meet the requirements for EN-61000-3-3, "Limitation of voltage fluctuations and flicker in low-voltage systems for equipment with rated current equal to or less than 16 amperes". To comply with these new regulations, equipment that requires continuous switching of AC power for its normal operation may require significant modifications in the manner in which electrical power is distributed to the system over a period of time. The proportional control heating systems found in various types of photographic film processing equipment are continuously switching AC power on and off to precisely maintain the temperatures of the processor chemistry baths and film drying system. The typical control systems utilized in this equipment will switch the AC power frequently over a period of time, to maintain the required temperature to the loads for each heater sub-system in the film processor. To maintain a close temperature control in a heater sub-system within a film processor, it is not uncommon for the power to the heating elements to be switching over 100 times per minute. Limiting the voltage fluctuations and flicker in this type of equipment will require an AC power control system that can minimize the number and the magnitude of each switched AC power demand over the measurement time period as specified in EN-61000-3-3. A typical power distribution system of this type can be considerably more complex and may increase the amount of heat dissipated in the film processing equipment. A simple methodology is needed that provides a controlled amount of power to the heating elements as needed to reach and maintain the required temperature of the equipment heater sub-systems and to minimize the amount of switched AC power transitions.

Electrical equipment, that minimizes multiple surges of power from the AC main power, has been designed to convert the alternating current to direct current and store this energy in large banks of capacitors or batteries for distribution, as needed, by the intended load. This type of system generally provides an even flow of power to the equipment and greatly minimizes the effects of the demand on the AC main power for continuous surges of power. These power distribution systems are generally much more complex, with lower reliability, in their operation and require a much larger physical space than is required by a conventional power supply and heater control system. They will increase the amount of heat that is dissipated in the system because the efficiency of the power conversion from AC to DC power will always be less than 100%. There is a need for a solution to these problems.

SUMMARY OF THE INVENTION

According to the present invention, there is provided a solution to the problems discussed above.

According to a feature of the present invention, there is provided a design consisting of two AC power control devices, both of which are connected in series between the AC main power and a single heater element load. One device will allow only the positive portion of the AC power to pass through it to the heater load. The second device will only allow the negative portion of the AC power to pass through to the load. By properly controlling both these devices the system can provide 100%, 50%, or 0% of the AC power to be applied to the heater load. To minimize the number of times that the AC power is switched, as required to meet the requirements of EN 61000-3-3 (Flicker), the heating system duty cycle and period may also be adjusted as required by hardware logic or via a software algorithm in the controller unit of the AC power heating control system.

According to another feature of the present invention, there is provided an electrical heater control system with reduced flicker comprising: an electrical heating system; an AC (alternating current) power source for supplying AC current to said electrical heating system; an AC power control device connected between said electrical heating system and said AC power source for controlling the supply of AC current to said electrical heating system; and a controller unit coupled to said AC power control device for activating said device at zero crossings of said AC power to minimize flicker in AC current supplied to said electrical heating system from said AC power source.

ADVANTAGEOUS EFFECT OF THE INVENTION

The invention has the following advantages.

1. Reduces voltage fluctuations on the AC main power line.
2. Reduces electromagnetic interference caused from high switching currents.
3. Provides half power or fall power to the load with minimal power dissipation from the device.
4. Provides the ability to increment the AC sine wave power to a load from 0, ½, and full power steps, or multiple power steps when used with multiple series or parallel heater loads.
5. Utilizes a device that switches on and off at the zero crossing of the AC sine wave, resulting in reduced EMI.
6. Requires a minimum of space to locate the half wave control devices.
7. Minimum cost of components to implement.
8. Increases reliability.
9. Reduces/minimizes temperature swings, providing increased temperature control.

DETAILED DESCRIPTION OF THE INVENTION

In film processing systems and other temperature controlled heating equipment that utilize laminator roller heaters, splicer heaters, fuser roller heaters, bath processing heaters, or air dryer heaters, a technique has been designed to minimize the large transition of AC power being applied to these heating elements. The AC power heating control system is designed with the ability to switch the power in 3 steps (0%, 50%, or 100%). The AC power control device, when activated, allows the power to be applied to the load, starting at approximately the zero crossing of the AC sine wave. Termination of the power to the load will always end at a zero voltage crossing of the AC sine wave, minimizing the potential of electromagnetic interference caused by switching high AC current.

This technique provides the ability to apply zero power, half power or full power to a load with minimal heat dissipation in the AC power control device. The heating system duty cycle and period may be adjusted accordingly to minimize the number of times that the AC power is switched during the period of measurement to provide compliance with the European voltage fluctuation and flicker regulations of EN 61000-3-3.

FIGS. 1 through 5 are embodiments of the invention which illustrate the variations of this methodology that reduce AC line voltage fluctuations resulting in a reduced flicker characteristic in high wattage heater systems.

Figure 1:
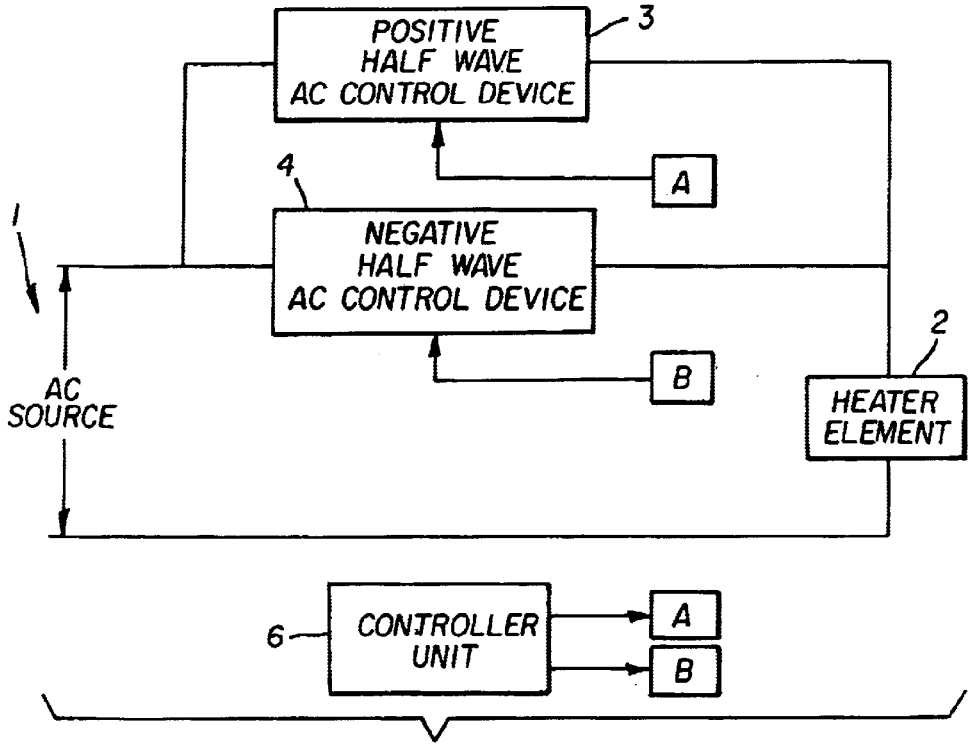
FIG. 1 is a block diagram of a first embodiment of the present invention utilizing paralleled positive and negative half wave control devices connected in series with a single heater load.

In the embodiment shown in FIG. 1, the AC power heating control system includes two AC power control devices 3 and 4 which are connected in parallel between the AC power source 1 and the heater load element 2. One control device 3 will allow the positive half wave of the AC sine wave to pass through it to the heater load 2. The other control device 4 will allow the negative half wave portion of the AC sine wave to pass through it to the heater load 2. By properly controlling both of these devices 3, 4 by controller unit 6, the system can provide 0%, 50%, or 100% of the AC power to be applied to the heater load 2.

Figure 2:
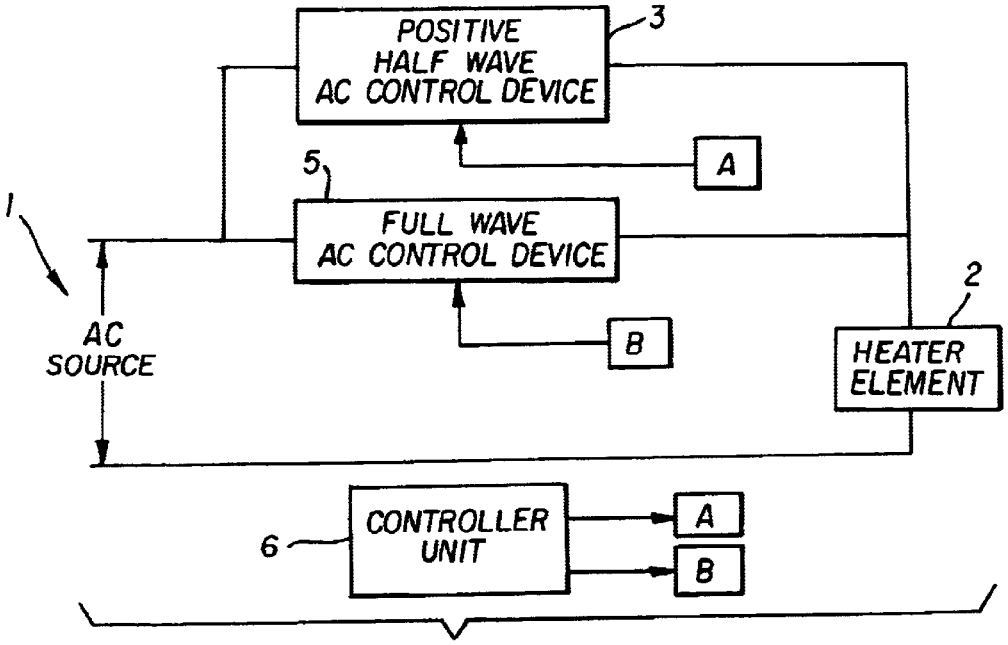
FIG. 2 is a block diagram of a second embodiment of the present invention utilizing paralleled positive and full wave control devices connected in series with a single heater load.

As shown in FIG. 2, which is a variation of FIG. 1, one full wave AC control device 5 and one half wave AC control device 3, connected in parallel, providing AC power from AC source 1 to a single heater load 2. One device 5 allows the control of the full AC sine wave to pass through it. The second device 3 allows only one half wave (either the positive or negative) of the AC sine wave to pass through. By properly activating device 3 or 5, this configuration provides 0%, 50% or 100% of the AC power to be applied to each heater load 2.

Figure 3:
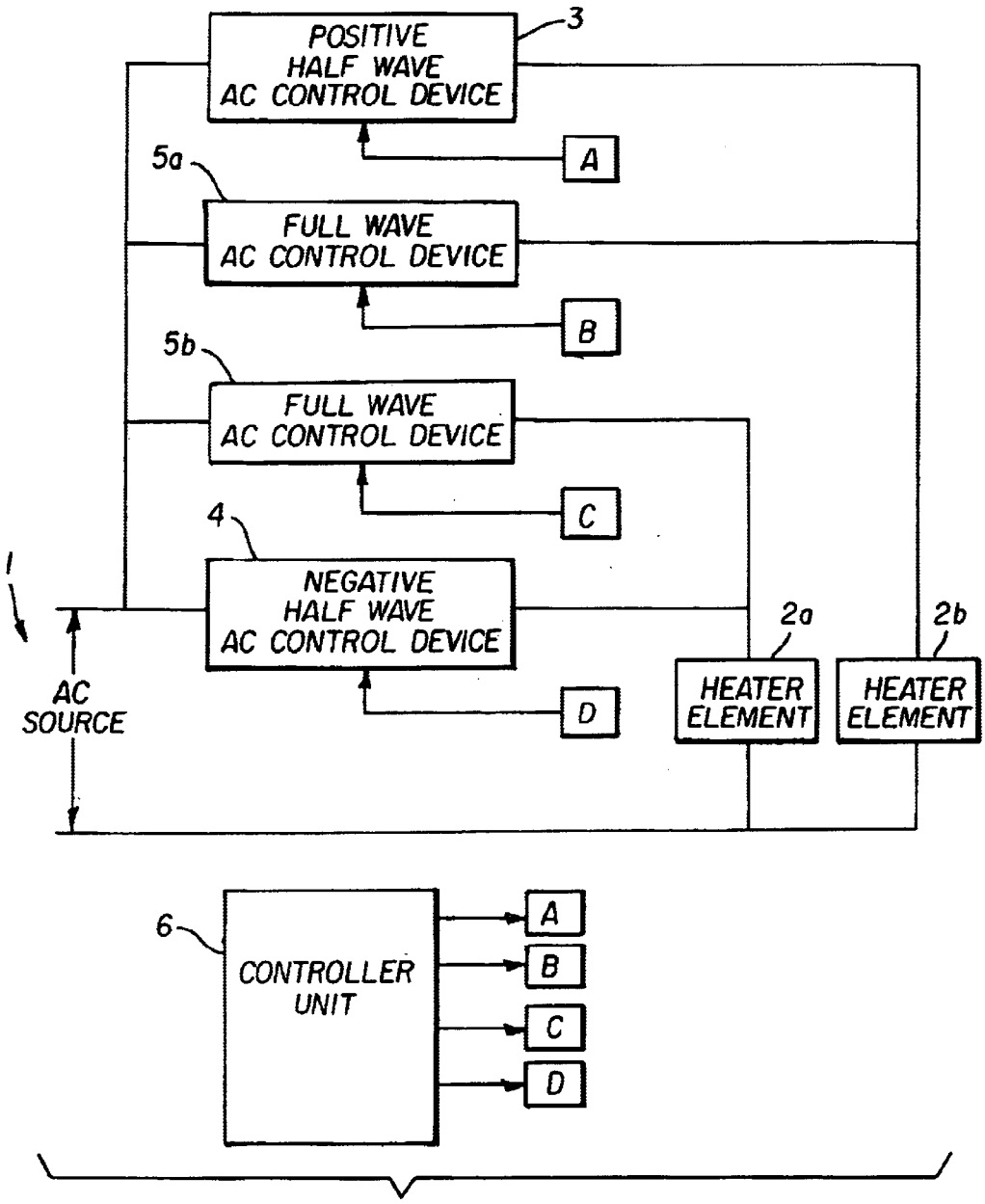
FIG. 3 is a block diagram of a third embodiment of the present invention utilizing two sets of paralleled positive and negative half wave control devices, each connected in series with one of a dual (split) load.

The embodiment shown in FIG. 3 utilizes a split heating element load that would allow power to be applied in multiple increments depending on the number of heater loads. As shown, a dual heating system with equal wattage loads 2*a*, 2*b* which can increase the power in 25% increments is described as follows: for one heating element load 2*a*, a pair of paralleled AC power control devices 5*a*, 3 which allows both full wave and only the positive half of the AC sine wave to pass through it, is connected between heater element 2*b* and the AC power source 1. For the second heating element 2*a*, a pair of paralleled AC power control devices 5*b*, 4 allow both fall wave and only the negative portion of the AC sine wave to pass through to heater element 2*a* from AC source 1. By controlling each AC power control device 3, 5*a*, 5*b*, 4 individually by control unit 6, power to each portion of the heating element 2*a*, 2*b* will be 0%, 50% or 100%. By selecting to apply power to one or both of the dual heating element 2*a*, 2*b*, the total power applied to the dual heater elements 2*a*, 2*b* can be 0, 25%, 50%, 75% or 100%. The number of increments in a multiple heater load system arrangement can be calculated to be equal to 2× "number" of multiple heater element loads.

Figure 4:
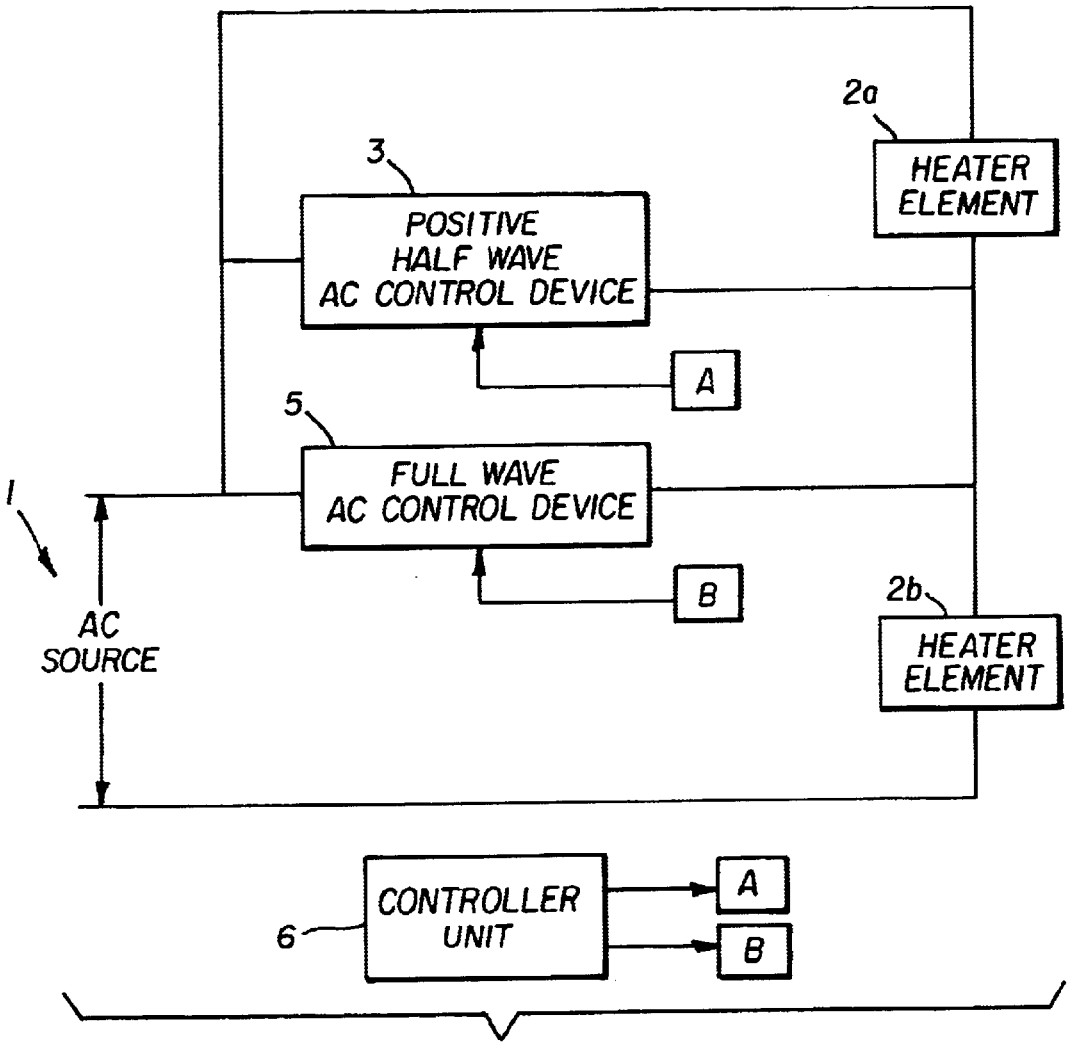
FIG. 4 is a block diagram of a fourth embodiment of the present invention utilizing paralleled positive half wave and a full wave control device connected in parallel with one load and in series with the other load.

In the embodiment as shown in FIG. 4, the heating system has two heater elements 2*a*, 2*b* in series that are on at all times to maintain a minimum temperature. The continuous application of a minimum level of power to the heating elements 2*a*, 2*b* at all times is advantageous in halogen heating lamps configurations, this reduces the large current surge that is characteristic when initially applying power to cold lamps. By utilizing a full wave control device 5, power is bypassed from the first series heater element 2*a*, to the second series heater element 2*b*. Thus, a high current fast warm up state can be implemented until the normal operating temperatures are obtained. While in operate mode, the half wave control device 3 in parallel with the full wave control device 5 to the second series heating element can provide additional heat as required by the heating control system.

Figure 5:
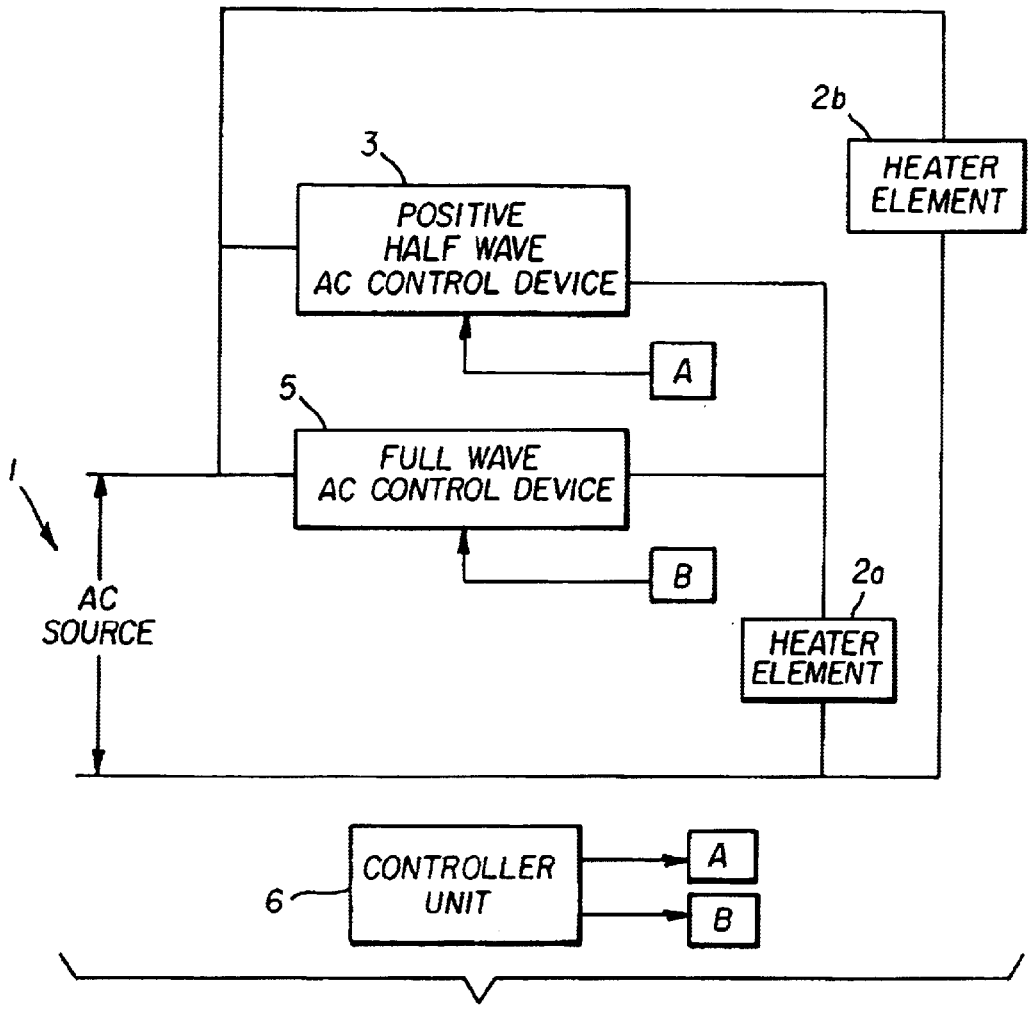
FIG. 5 is a block diagram of a fifth embodiment of the present invention utilizing paralleled positive half wave and a full wave control device connected in series with one of the loads.

In the embodiment shown in FIG. 5, the heating system has two parallel heating elements 2*a*, 2*b* with heating element 2*b* on at all times to maintain temperature. By utilizing a full wave control device 5, as controlled by control unit 6 to supply power to second parallel heating element 2*a*, a high current fast warm up state can be implemented until the normal operating temperatures are obtained. Added heat can be provided as required by the heating control system while in the operate mode by selectively activating devices 3 and 5 by controller unit 6 to supply power to heater element 2*a*.

When the above circuits are used in duplicates, as would be required for fuser roller systems, laminator roller systems, or other similar systems where each system requires independent temperature control, the half wave control devices are used to control opposite half waves of the sine wave power so as to reduce peak currents. If the combination of the two half wave control devices are used to control half wave of the sine wave power of the same polarity, one device is controlled such that it is not activated until the other half wave control device is turned off. Controller unit 6 can be hardware, firm ware, software or hybrid control system.

The invention is also applicable to thermographic imaging systems where media is exposed to radiation to create a latent image which can then be thermally processed to develop a latent image. A typical media is photosensitive media, such as film or paper which is exposed to a light image which is representative of a medical image, such as a radiographic image. The media is contacted by a drum or belt which is heated by an electrical heater controlled according to the present invention.

The invention has been described in detail with particular reference to certain preferred embodiments thereof, but it will be understood that variations and modifications can be effected within the spirit and scope of the invention.

PARTS LIST

1 AC source
2*a* heater element
2*b* heater element
3 positive half wave AC control device
4 negative half wave AC control device
5*a* full wave AC control device
5*b* full wave AC control device
6 controller unit

What is claimed is:

1. An electrical heater control system with reduced flicker comprising:

an electrical heating system;

an AC (alternating current) power source for supplying AC current to said electrical heating system;

an AC power control device connected between said electrical heating system and said AC power source for controlling the supply of AC current to said electrical heating system; and a controller unit coupled to said AC power control device for activating said device at zero crossings of said AC current to reduce flicker caused from voltage variations created from activations and deactivations of said electrical heating system from said AC power source; and to supply the AC current to said electrical heating system from 0, ½, and full power steps.

2. The control system of claim 1 wherein said electrical heating system includes a single heater element;

wherein said AC power control device includes a positive half wave AC control device and a negative half wave AC control device connected in parallel; and wherein selective activation of neither, one or both of said half wave AC control devices by said controller unit results in said power steps of the AC current from said AC power source to be supplied to said single heater element.

3. The control system of claim 1 wherein said electrical heating system includes a single heater element;

wherein said AC power control device includes a positive or negative half wave AC control device and a full wave AC control device connected in parallel; and wherein selective activation of neither, one or both of said full wave AC control devices or said half wave AC control device by said controller unit results in said power steps of the AC current from said AC power source to be supplied to said single heater element.

4. The control system of claim 1 wherein said electrical heating system includes at least first and second heater elements connected in parallel;

wherein said AC power control device includes at least first and second AC rower control devices for controlling the supply of AC current to a respective one of said at least first and second heater elements; and wherein selective activation of said first and second AC power control devices by said controller unit results in said power steps of the AC current from said AC power source to be supplied to each of said first and second elements and wherein the total AC current supplied to both said heater elements is from 0, ¼, ½, ¾, and full power steps thereof.

5. The control system of claim 4 wherein said first and second AC power control devices include either one of (a) positive and negative half wave AC control devices connected in parallel; or (b)

a positive or negative half wave AC control device and a full wave AC control device connected in parallel.

6. The control system of claim 1 wherein said electrical heating system includes first and second heater elements connected in series;

wherein said first heater element is connected directly to said AC power source so that a continuous supply of AC current is supplied to said first heater element; and wherein said AC power control device includes either one of (a) a positive and a negative half wave AC control devices connected in parallel, or (b) a positive or a negative half wave AC control device and a full wave AC control device connected in parallel.

7. The control system of claim 1 wherein said electrical heating system includes first and second heater elements connected in parallel;

wherein said first heater element is connected directly to said AC power source so that a continuous supply of AC current is supplied to said first heater element; and wherein said AC power control device includes either one of (a) positive and negative half wave AC control devices connected in parallel, or (b) a positive or a negative half wave AC control device and a full wave AC control device connected in parallel.

* * * * *